US006168101B1

(12) United States Patent
Xie

(10) Patent No.: US 6,168,101 B1
(45) Date of Patent: Jan. 2, 2001

(54) STAINLESS STEEL CHOPPER/MIXER-GRINDER WORM HAVING IMPROVED RESISTANCE TO FATTING

(75) Inventor: Mark Mingjun Xie, Tipp City, OH (US)

(73) Assignee: Premark FEG L.L.C., Wilmington, DE (US)

( * ) Notice: Under 35 U.S.C. 154(b), the term of this patent shall be extended for 0 days.

(21) Appl. No.: 09/406,924

(22) Filed: Sep. 28, 1999

(51) Int. Cl.[7] ..... B02C 19/22
(52) U.S. Cl. ..... 241/82.5; 241/260.1; 427/433
(58) Field of Search ..... 241/82.1–82.7, 241/260.1, 300; 99/355; 427/433, 405

(56) References Cited

U.S. PATENT DOCUMENTS

| | | | | |
|---|---|---|---|---|
| 1,776,603 | | 9/1930 | Schulte . | |
| 3,590,725 | * | 7/1971 | Bilynsky | 99/355 |
| 3,768,741 | | 10/1973 | Mills . | |
| 3,984,056 | | 10/1976 | Hartley . | |
| 4,273,625 | | 6/1981 | Van de Leest et al. . | |
| 4,736,896 | | 4/1988 | Wagner . | |
| 5,040,735 | | 8/1991 | Wensing . | |
| 5,344,550 | | 9/1994 | Kaneda et al. . | |
| 5,584,943 | | 12/1996 | Banaszak et al. . | |
| 5,607,113 | | 3/1997 | McGuffin, Sr. et al. . | |
| 5,628,466 | | 5/1997 | Haack et al. . | |
| 5,667,153 | | 9/1997 | Haack et al. . | |
| 5,670,265 | | 9/1997 | Grell et al. . | |
| 5,791,570 | | 8/1998 | Quadrana . | |
| 5,894,999 | | 4/1999 | Moessmer et al. . | |

* cited by examiner

*Primary Examiner*—Mark Rosenbaum
(74) *Attorney, Agent, or Firm*—Thompson Hine & Flory LLP

(57) ABSTRACT

A worm for a chopper is formed of an elongated stainless steel member having at least one convolution extending thereabout for contacting and moving meat when the elongated stainless steel member is rotated. A meat contacting outer surface portion of the elongated stainless steel member is coated in tin for reducing build up of fat on the meat contacting outer surface portion during operation.

9 Claims, 1 Drawing Sheet

STAINLESS STEEL CHOPPER/MIXER-GRINDER WORM HAVING IMPROVED RESISTANCE TO FATTING

FIELD OF THE INVENTION

The present invention relates generally to food choppers and mixer-grinders, and more particularly, to a stainless steel worm for a food chopper or mixer-grinder having improved resistance to fatting.

BACKGROUND OF THE INVENTION

Mixer-grinders and choppers are routinely used in the preparation of ground meat and similar food products. Conventional choppers and mixer-grinders employ a worm for moving meat forwardly to a grinding head where the meat is cut by a chopper knife and forced through a chopper plate having a plurality of apertures. The use of worms for such purposes is well known as represented by U.S. Pat. Nos. 5,607,113 and 3,984,056. In the past, the worms utilized in such choppers and mixer-grinders have been formed of cast iron or ordinary steel. In order to prevent corrosion of the cast iron or ordinary steel, it is known to coat the cast iron or ordinary steel worm with tin using a hot dip tin coating process.

Worms have also been formed of stainless steel and, due to the resistance of stainless steel to corrosion and rusting, tin coatings have not been used on such stainless steel worms. One problem experienced with stainless steel worms is the occurrence of "fatting." Fatting is a term of art referring to the build up of meat fat on the working surface of the worm, and results in reduced productivity of the chopper or mixer-grinder. In other words, when fat builds up on the working surface of the worm, the worm is less effective at moving meat forward to the chopper knife and chopper plate. Fatting may be caused by a combination of factors including surface finish and surface adhesion. A smoother surface finish results in less fatting, and a less surface adhesion results in less fatting. Accordingly, in order to reduce fatting of stainless steel worms attempts have been made to smoothly polish the surface of the stainless steel worm and, while somewhat effective, such fine polishing significantly increases the manufacturing cost of stainless steel worms.

Accordingly, it would be desirable and advantageous to provide a stainless steel worm constructed to effectively and relatively inexpensively reduce the occurrence of fatting.

SUMMARY OF THE INVENTION

In one aspect of the present invention, a method of reducing fatting on the surface of a stainless steel worm involves applying a coating of tin to a meat contacting outer surface portion of the stainless steel worm. Applicants have recognized the ability to reduce fat build up on the surface of stainless steel worms by applying a tin coating. The application of such tin coating to a stainless steel part is counterintuitive in view of the fact that tin coatings have heretofore only been recognized for prevention of corrosion and rust, and stainless steel worms are not subject to corrosion or rust.

DETAILED DESCRIPTION OF THE EMBODIMENTS

Figure 1:
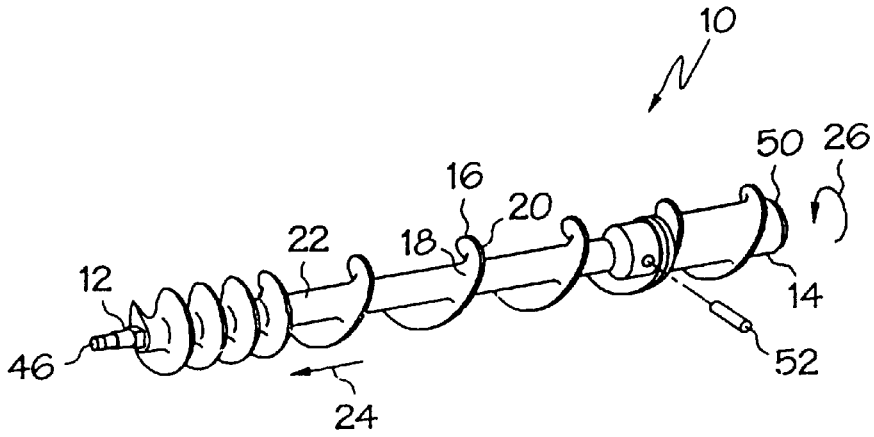
FIG. 1 is a perspective view of one embodiment of a worm of the present invention.

Referring to drawing FIG. 1, an exemplary worm 10 of a mixer-grinder or chopper is shown. As used throughout the remainder of this specification and in the claims, the term "chopper" is used to refer to any piece of food equipment which utilizes a worm to move a food product along a path toward a cutting location, including, but not limited to mixer-grinders. Worm 10 includes front and rear ends 12 and 14, with a convolution 16 extending between such ends. Convolution 16 is defined by surfaces 18 and 20 which extend from axial portion 22 in a spiraling manner. Arrow 24 defines the typical direction of movement of meat when worm 10 is rotated in the direction depicted by arrow 24. During such rotation, surface 18 acts as a working surface which contacts the meat, moving it forward 24.

Figure 2:
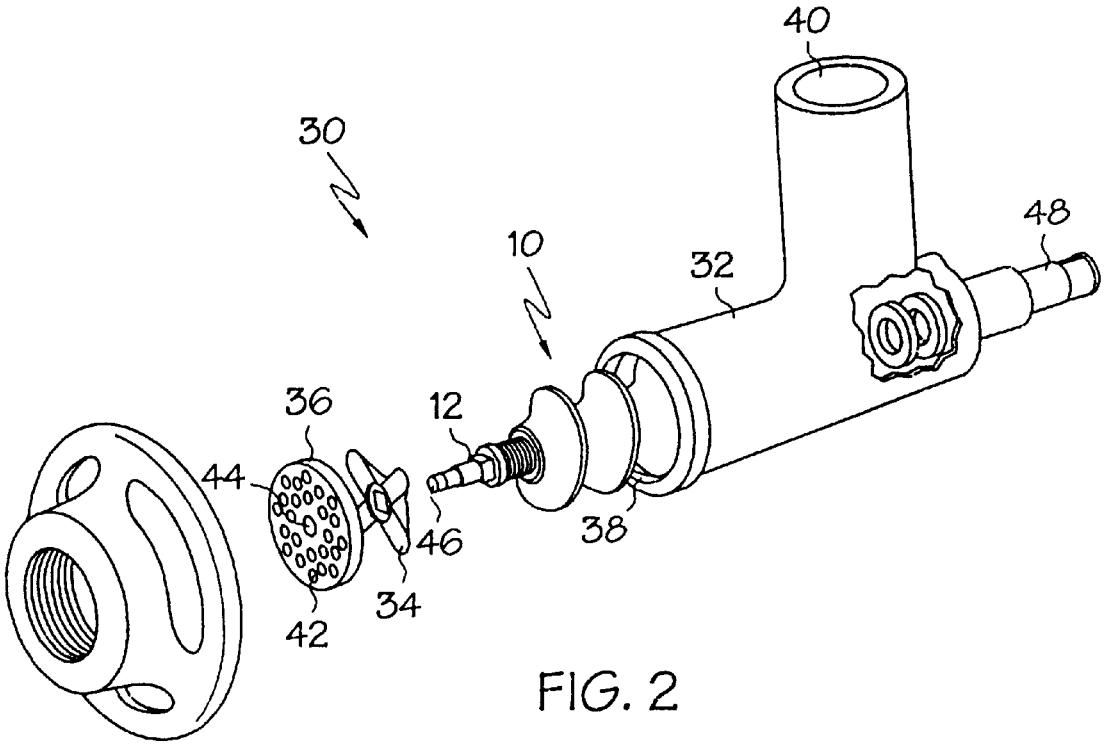
FIG. 2 is a perspective view of one embodiment of a worm assembly including a worm of the present invention.

An exemplary worm assembly 30 including worm 10, a chopper cylinder 32, a chopper knife 34 and chopper plate 36 are illustrated in FIG. 2. Chopper cylinder 32 includes an open end 38 from which worm 10 extends, and a meat entry opening 40. Chopper knife 34 connects to front end 12 of worm 10 for movement therewith. Chopper plate 36 includes a plurality of apertures 42 through which meat is pushed, along with a centrally disposed mount opening 44 for positioning about a nose portion 46 of worm front end 12, nose portion 46 rotating relative to chopper plate 36 when the chopper plate 36 is so positioned. Chopper cylinder 32 defines a path of travel for meat product, with rotation of worm 10 causing movement of meat along the path of travel. Drive shaft 48 extends from a rear end of chopper cylinder 32 for facilitating rotation of worm 10, drive shaft 48 extending into a shaft receiving opening 50 at rear end 14 of worm 10 and being pinned thereto via pin 52.

Thus worm 10 is formed of elongated stainless steel portion 22 having at least one convolution 16 extending thereabout for contacting and moving meat. The present invention provides that a meat contacting outer surface portion of the worm 10 is coated in tin for reducing build up of fat thereon. The outer meat contacting surface portion must include at least working surface 18. However, it is recognized and preferred that the entirety of the outer surface of the worm 10, including the outer surface of elongated portion 22 and both surfaces 18 and 20, be coated in tin to achieve the best result.

The worm 10 may be coated with tin using a hot dip tin process which is commonly known and used in the art for coating iron and ordinary steel components. The hot dip tin process involves heating a tin alloy into a molten form and dipping the component into the molten tin alloy until a desired coating thickness is achieved. In this regard, an exemplary tin alloy preferably includes a minimum of 99.8% tin and may include trace amounts of other elements such as copper, iron, and zinc.

This tin alloy represents merely one example of a suitable tin alloy for use in connection with the present invention. The thickness of the tin coating should preferably be approximately 0.001 inches.

To extend the present invention, the inner surface portion of the chopper cylinder 32 could also be coated with tin, as such inner surface defmes the path of travel of meat and is also subject to fatting. However, tin coating of the chopper cylinder is not absolutely necessary.

Importantly, applicant has discovered that a tin coating can reduce fatting when applied to a stainless steel worm or stainless steel worm assembly. Test results indicate that by utilizing a tin coating in accordance with the present invention, fatting can be reduced by at least fifty percent (50%) as compared to stainless steel worms and worm assemblies without such tin coatings. The tin coating provides a smoother surface finish than stainless steel and also provides lower surface adhesion than stainless steel.

Although the invention has been described and illustrated in detail it is to be clearly understood that the same is intended by way of illustration and example only and is not intended to be taken by way of limitation. Accordingly, the spirit and scope of the invention are to be limited only by the terms of the appended claims.

What is claimed is:

1. A worm for a chopper, the worm comprising:

an elongated stainless steel member having at least one convolution extending thereabout for contacting and moving meat when the elongated stainless steel member is rotated;

wherein a meat contacting outer surface portion of the elongated stainless steel member is coated in tin for reducing build up of fat on the meat contacting outer surface portion during operation.

2. The worm of claim 1 wherein the tin coating comprises a hot dip tin coating.

3. The worm of claim 2 wherein the tin coating is comprised of at least 99.8% tin.

4. The worm of claim 3 wherein the tin coating has a thickness of about 0.001 inches.

5. A worm assembly for a chopper, the worm assembly comprising:

an elongated stainless steel member having at least one convolution extending thereabout for contacting and moving meat when the elongated stainless steel member is rotated;

a stainless steel chopper cylinder, at least part of the elongated stainless steel member being positioned within the chopper cylinder;

wherein a meat contacting outer surface portion of the elongated stainless steel member is coated with tin for reducing build up of fat on the meat contacting outer surface portion during operation; and wherein at least a meat contacting inner surface portion of the stainless steel chopper cylinder is coated with tin for reducing build up of fat on the meat contacting inner surface portion during operation.

6. The worm assembly of claim 5 wherein the tin coating of the elongated stainless steel member and the tin coating of the stainless steel chopping cylinder are both formed of at least 99.8% tin and both have a thickness of about 0.001 inches.

7. A method of improving fatting resistance of a stainless steel worm, comprising:

applying a coating of tin to a meat contacting outer surface portion of the stainless steel worm.

8. The method of claim 7 wherein the applying step comprises dipping the stainless steel worm into a hot, molten tin alloy.

9. The method of claim 7 wherein the tin coating is applied with a thickness of about 0.001 inches.

* * * * *